United States Patent [19]

Boerigter

[11] 4,315,466

[45] Feb. 16, 1982

[54] ADJUSTABLE TABLE

[75] Inventor: Milton E. Boerigter, Hamilton, Mich.

[73] Assignee: Fleetwood Furniture Company, Zeeland, Mich.

[21] Appl. No.: 111,385

[22] Filed: Jan. 11, 1980

[51] Int. Cl.[3] ..... A47B 9/12

[52] U.S. Cl. ..... 108/147; 108/144; 248/188.5

[58] Field of Search ..... 108/147, 146, 144, 145, 108/148, 95, 96, 105, 106, 116, 10; 248/188.5; 5/63

[56] References Cited

U.S. PATENT DOCUMENTS

| | | | |
|---|---|---|---|
| 2,692,169 | 10/1954 | Phillips | 5/63 X |
| 2,830,303 | 4/1958 | Sandock | 5/63 |
| 3,271,795 | 9/1966 | Hillenbrand et al. | 5/63 |
| 3,820,176 | 6/1974 | Feiertag | 108/147 |
| 4,130,069 | 12/1978 | Evans et al. | 108/144 |

FOREIGN PATENT DOCUMENTS

| | | | |
|---|---|---|---|
| 1429534 | 1/1969 | Fed. Rep. of Germany | 108/147 |
| 2618558 | 11/1977 | Fed. Rep. of Germany | 108/147 |
| 2710926 | 9/1978 | Fed. Rep. of Germany | 108/147 |
| 2411588 | 12/1977 | France | 108/147 |
| 355582 | 8/1961 | Switzerland | 108/147 |

*Primary Examiner*—James T. McCall

*Attorney, Agent, or Firm*—Price, Heneveld, Huizenga & Cooper

[57] ABSTRACT

A height adjustable table adapted for wheelchair use includes a top member and depending end panels defining channel structure for telescopingly receiving leg structures at the ends of the top member. An actuator includes an extendable and retractable rod which is connected to the leg structures by flexible cables which are reeved over pulleys. Extension and retraction of the rod results in raising and lowering of the top member and end panels with respect to the leg structures. Readily accessible hand controls are positioned for easy access by the user for raising and lowering the top member. An adjustable control automatically limits the maximum height of the top surface with respect to the leg structures.

17 Claims, 6 Drawing Figures

ADJUSTABLE TABLE

BACKGROUND OF THE INVENTION

The present invention relates to furniture expressly adapted for handicapper use and more particularly to a continuously height adjustable table adapted for wheelchair use.

Conventional desks, work surfaces, therapy tables, craft tables and the like have a fixed relationship between the top surface thereof and the leg structures. These tables are not conveniently used by a handicapped individual in a wheelchair. The height of the top member or work surface of such tables and desks is such that the wheechair user may not be able to move up under the work surface or the work surface may be elevated too high above the wheelchair to permit convenient use by the handicapped individual. The height of the table top or desk is rarely convenient for the wheelchair occupant.

Several forms of height adjustable tables, desks and the like have heretofore been proposed for handicapped use. These structures generally require hand tools for height adjustment or manual extension and retraction of leg structures. As a result, they are not readily and easily usable by a handicapped individual. Further, they are not easily usable by different individuals of different size who are confined to different size wheelchairs. An example of one manually adjustable wheelchair table may be found in U.S. Pat. No. 3,915,102, entitled WHEELCHAIR TABLE and issued on Oct. 28, 1975, to Barron. The table disclosed in this patent includes telescoping leg structures which are manually moved and locked in position by scissor-like spring loaded locking pins.

A need exists for a continuously height adjustable table, desk, work surface or the like which is expressly adapted for wheelchair use, which may be raised and lowered with ease by an individual in a wheelchair and which is relatively easy to manufacture, stable and reliable in use.

SUMMARY OF THE INVENTION

In accordance with the present invention, a height adjustable table or the like is provided whereby the needs of a handicapped user are satisfied and the problems heretofore experienced in the prior art are substantially eliminated. Essentially, the height adjustable table or work surface includes a top member, a frame structure secured to the underside of the top member and a pair of leg structures telescopingly received within the frame structure. Provision is made for raising and lowering the top member with respect to the leg structures. The structure includes an actuator having an extendable and retractable rod and hand-operated controls for activating the actuator. Further, provision is made for limiting the maximum height adjustment and hence the maximum extension of the rod.

In one embodiment of the present invention, the actuator is a conventional, standard hydraulic jack having a self-contained fluid reservoir, a lever operated pump and a bleed valve adjustable from a closed position to an open position to permit retraction of the rod and lowering of the table top by gravity. A reciprocating straight line pull-type control handle is secured to the table and connected through a flexible cable to the lever of the pump of the jack. Simple straight line pulling motion of the easy-to-grasp control handle raises the table to a new height with each pull. A second control handle is operably connected to the bleed valve to permit opening thereof for lowering of the table top. Further, an adjustable cam coacts with the bleed valve to limit the maximum height adjustment of the table. This permits ready adaptability of a conventional hydraulic jack type actuator into the table.

In an alternative embodiment, an electric motor driven lead screw type actuator is connected by flexible cables to the leg structures for raising and lowering of the table top. Straight line up/down switches are mounted conveniently for use by the handicapped individual to actuate the electric motor drive. Further, limit switches are positioned on the frame structure to limit the maximum extension of the rod and hence the maximum height of the table.

DETAILED DESCRIPTION OF THE PREFERRED EMBODIMENT

Figure 1:
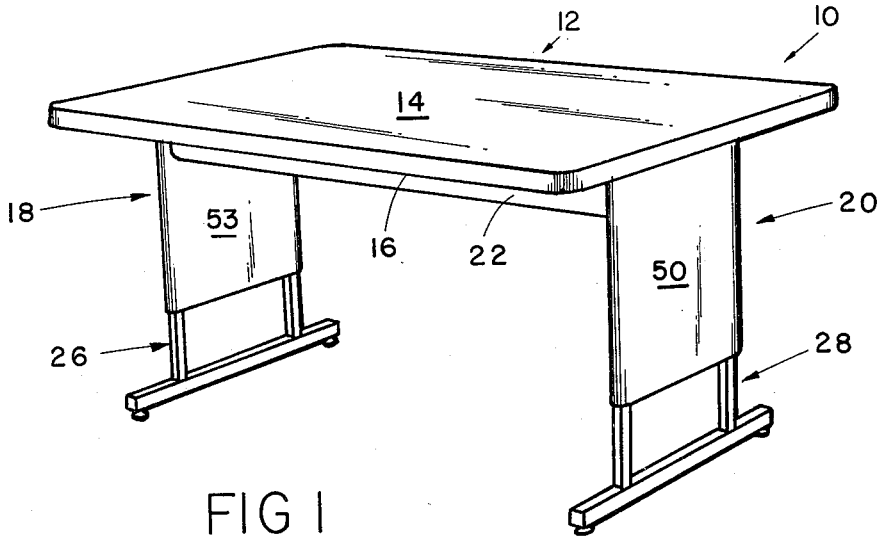
FIG. 1 is a perspective view of a height adjustable table in accordance with the present invention.
Figure 2:
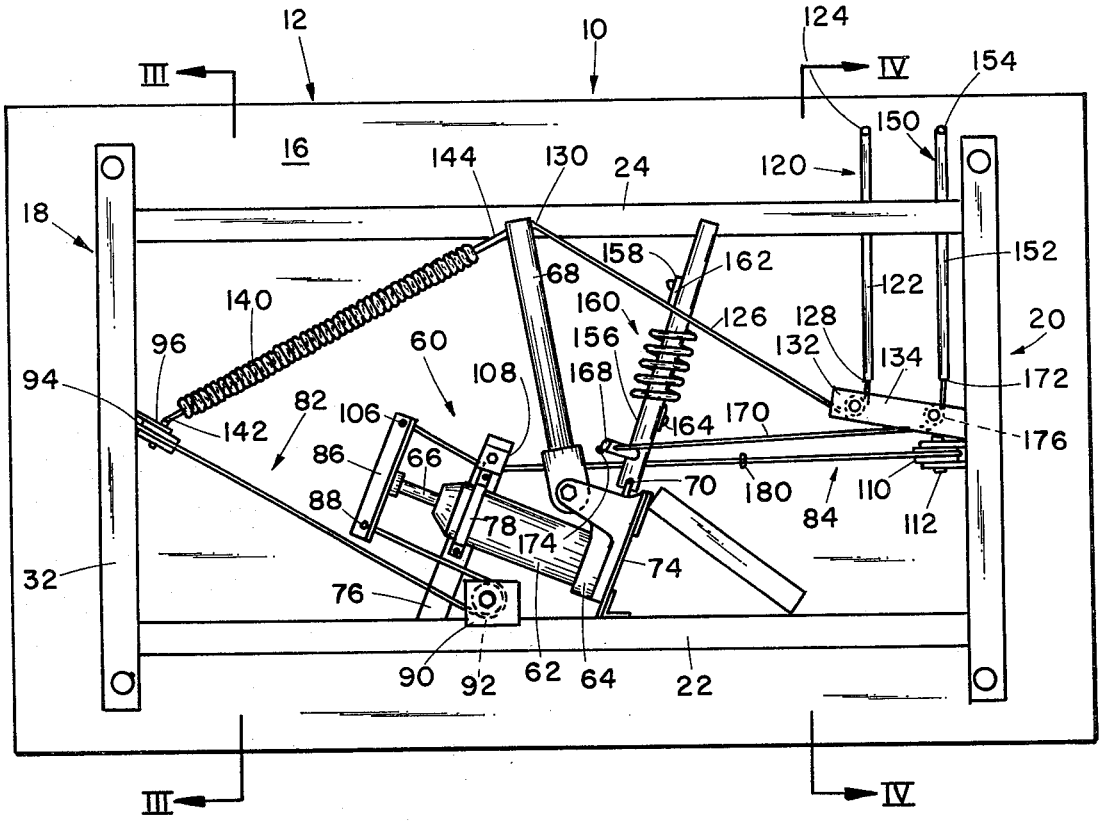
FIG. 2 is a bottom plan view of one embodiment of the height adjustable table showing the hydraulic jack actuator and the control mechanism.

A preferred embodiment of the continuously height adjustable table for wheelchair use is illustrated in FIG. 1 and generally designated 10. Table 10 includes a rectangular top member 12 defining a work surface 14. Secured to the underside 16 of top member 12 are a pair of end panel structures 18, 20. End panels 18, 20 are positioned at transverse edges of the table top 12 and define a rectangular frame structure with side members 22, 24 (FIG. 2). A pair of leg structures 26, 28 are telescopingly received within end panels 18, 20, respectively.

Figure 3:
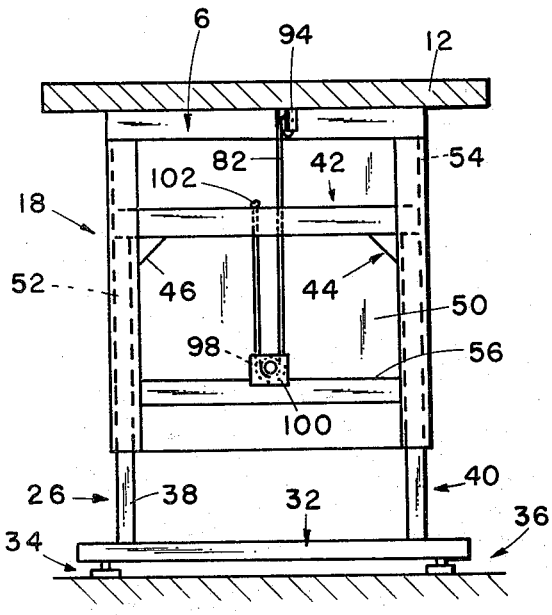
FIG. 3 is a cross-sectional view taken generally along line III—III of FIG. 2.
Figure 4:
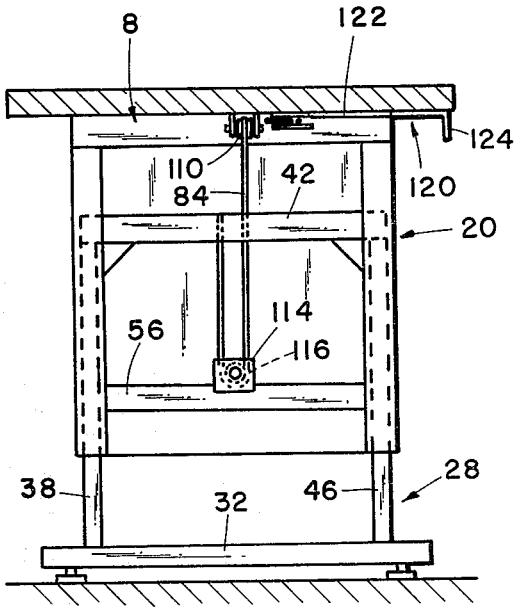
FIG. 4 is a cross-sectional view taken generally along line IV—IV of FIG. 2.

As best seen in FIGS. 1, 3 and 4, each leg structure 26, 28 includes a horizontal base 32 and a pair of depending adjustable foot pads 34, 36. Foot pads 34, 36 include members threadably received within apertures at the undersurface of base member 32. Extending vertically from base member 32 are a pair of spaced standards 38, 40. Standards 38, 40 are interconnected at the top by a transverse cross member 42 which is reinforced by suitable gussetings 44, 46 screwed to members 38, 40 and 42. Members 32, 38 and 40 are preferably tubular steel members weldably interconnected.

End panels 18, 20 each include an outer steel panel 50 and integrally formed spaced L-shaped channel members 52, 54 extending along the lateral edges of the outer panel 50. Members 52, 54 are interconnected adjacent the lower ends by another cross piece 56. The ends of outer panel 50 are formed to define a pair of channel-like members 52 and 54 for receipt of the upright standards 38, 40 of the leg structures. Each end of the table includes an inner cover panel 53 (shown in FIG. 1 only) which serve to enclose the operating mechanism for the leg assemblies. As a result, the leg structures are telescopingly received within the end panel members which form a portion of the frame of the table.

As seen in FIG. 2, the end panels are interconnected by steel side plates 22, 24. Table top 12, plates 22, 24 and end panels 18, 20 may be raised and lowered on the leg structures 26, 28. Further, the leg structures through foot pads 34, 36 are adjustable for leveling of the work surface 14 defined by the table top 12.

In the embodiment illustrated in FIG. 2, the means for raising and lowering the table top member 12 with respect to the leg structures 26, 28 includes a standard hydraulic jack 60. The hydraulic jack 60 may, for example, be of the type employed as an automotive jack. Jack 60 is a readily available item and includes a cylinder 62, a housing 64, an extendable and retractable rod 66, a pump disposed within the housing and actuated by a lever arm 68 and a bleed valve 70. In operation, rocking motion of lever 68 pumps hydraulic fluid into the cylinder 62 forcing a piston (not shown) to extend rod 66. Bleed valve 70, which is normally closed, is rotatable to an open position permitting fluid in cylinder 62 to drain back to the reservoir permitting rod 66 to be retracted within the cylinder. Jack 60, as seen in FIG. 2, is mounted on bracket structure including a first bracket member 74 secured to side frame 22 and a second bracket 76 also secured to side frame 22. A strap 78 held by suitable fasteners surrounds the upper end of the cylinder 62. The brackets and strap securely mount the jack actuator beneath the work surface 14 of the table top member 12.

Rod 66 is interconnected to the leg structures 26, 28 by flexible motion transmitting means in the form of cables 82, 84. A cross piece 86 is secured to the end of rod 66. Cable 82 has an end 88 secured to the cross piece and reeved around a pulley 90 rotatably mounted within a bracket 92 secured to side member 22. The cable then passes over another pulley 94 rotatably supported within a bracket 96 secured to end or cross member 6. Pulleys 92, 94 and 98 change the direction of cable 82. As seen in FIG. 3, cable 82 passes downwardly from pulley 94 through suitable apertures in member 42 to a third pulley 98 rotatably supported within a bracket 100 intermediate the ends of cross piece 56. Cable 82 then passes upwardly and is secured at an end 102 to cross piece 42.

Similarly, cable 84 has an end 106 secured to cross piece 86. Cable 84 passes over a pulley 108 mounted on bracket 76 and around a pulley 110 mounted on a bracket 112 secured to end member 8. Cable 84, as seen in FIG. 4, then passes downwardly through cross piece 42 and around another pulley 114 rotatably supported within a bracket 116 on cross piece 56 of end panel 20. Cable 84 then passes upwardly and is secured to cross piece 42 of leg structure 28. As is readily apparent, extension of rod 66 raises end panels 18, 20 and table top 12 with respect to and on the leg structures 26, 28 through cables 82, 84.

Rocking action of lever 68 and hence extension of rod 66 is accomplished through a reciprocating, straight line control member 120. Control member 120, as seen in FIGS. 2 and 4, is generally L-shaped and includes an elongated leg 122 passing through suitable apertures formed in side frame 24 and a depending leg 124 which may be grasped by the user. A cable 126 is secured at an end 128 to leg 122 and at another end 130 to lever 68. Cable 126 passes over and is reeved around a pulley 132 supported on a bracket 134. As should be apparent, simple straight line pulling motion of control member 120 will rotate lever 68 in a clockwise direction when viewed in FIG. 2 to actuate the pump (not shown) within the jack 60 resulting in extension of rod 66.

Lever 68 is returned to its initial start position by an elongated coil spring 140. Coil spring 140 has an end 142 fixed to bracket 96 and another end 144 fixed to lever 68. Spring 140, therefore, biases lever 68 in a counterclockwise direction when viewed in FIG. 2. Spring 140 is selected to provide merely a sufficient force to return the lever 68 to its start position. Simple straight line pulling motion of control member 120 actuates the lever 68 resulting in raising of the table.

The table is returned, in a controlled manner, to a lowered position through bleed valve 70 of jack 60. A second, straight line control member 150 is also supported within side frame 24 for pulling movement. Member 150 similarly includes an elongated leg 152 and a depending leg 154 which is easily grasped by the user. A cylindrical extension 156 is secured to bleed valve 70 rotatably supported within a cylindrical socket 158 secured to frame member 24. A coil spring 160 is fixed at an end 162 to socket 158 and at an opposite end 164 to extension 156. Coil spring 160 rotatably biases extension 156 so that bleed valve 70 is biased to its closed position. A rod or pin-like member 168 passes through extension 156. Control 150 is connected to rod or pin 168 through a flexible cable 170. Cable 170 has an end 172 secured to leg portion 152 and an opposite end 174 secured to pin 168. Cable 170 is reeved around a pulley 176 supported on bracket 134. As should be apparent, straight line pulling motion on control 150 causes cable 170 to rotate extension 156 against the bias of spring 160 thereby opening bleed valve 70. As a result, hydraulic fluid within the cylinder 62 may bleed, in a controlled manner, back to the reservoir within housing 64 and the table top under the action of gravity will lower on the leg structures 26, 28.

Provision is made for automatically limiting the maximum height of the table top and hence the maximum extension of rod 66 from jack 60. In the embodiment illustrated in FIG. 2, the height limiting means comprises a cam 180 secured to cable 84. Cam 180 may take the form of a simple cable clamp which may be adjustably positioned on cable 84. Pin 168 extends through cylindrical extension 156 immediately adjacent cable 84. As should be apparent, upon extension of rod 66, cam 180 will shift to the left, when viewed in FIG. 2, and engage pin 168 which functions as a cam follower. As cam 180 engages pin 168, extension 156 will be rotated against the bias of spring 160 and bleed valve 70 will be opened. Further actuation of control member 120 will then not result in further extension of rod 66. The table top will assume the position wherein cam 180 is just in engagement with pin 168 and the valve 70 is in its closed position. This automatic height adjustment limiting feature permits the ready adaption of a wide variety of hydraulic jacks 60 to the table. Also, the maximum height of the table may be adjusted to suit the needs of a wide variety of individuals. The maximum height is easily set by shifting cam 180 along cable 84.

The table in accordance with the present invention is simple, reliable and easily assembled. Prior structures did not permit easy raising and lowering of the table top by a person who is confined to a wheelchair. With the adjustable table in accordance with the present invention, the user need merely grasp the convenient, readily positioned handle 120 and in a simple straight line pulling motion, achieve raising of the table top. Lowering of the table top is readily achieved merely by pulling on control 150 which opens bleed valve 70 permitting retraction of piston 66 under the weight of the table top and frame structure. The flexible interconnecting means or motion transmitting means in the form of cables 82, 84, 126, 170 are relatively inexpensive and readily available items. The cables and actuator result in smooth and reliable table action. The control handles 120, 150 are readily positionable for either right-hand or left-hand use and may be mounted to extend from or adjacent the lateral edge of the table top 12 or from a transverse edge thereof depending upon personal preference. The end panels, telescoping legs and actuating mechanism are readily adapted to a wide variety of furniture structures including craft tables, desks, therapy tables and work stations. The force required to pull control member 120 and hence raise the table is minimal and in existing embodiments is on the order of 10 to 15 pounds. The leg structures, end panels and frame provide a stable structure readily used by the handicapped individual which permits continuous height adjustment without the necessity for hand tools.

ALTERNATIVE EMBODIMENT

Figure 5:
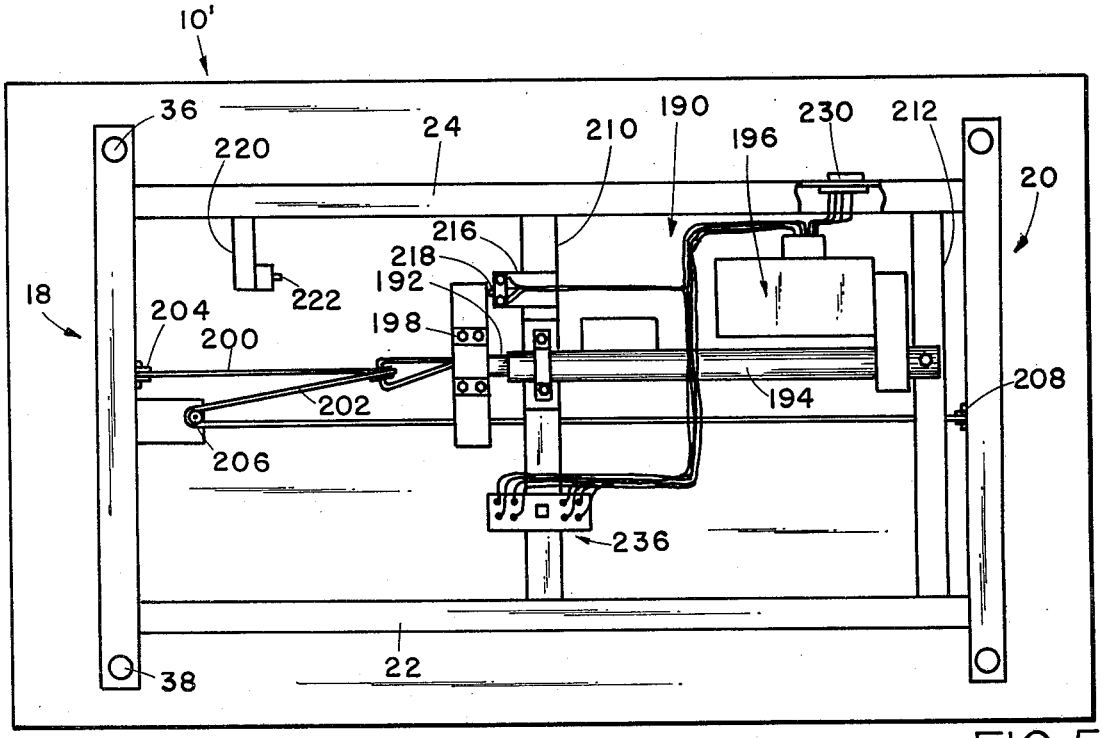
FIG. 5 is a bottom plan view of the height adjustable table showing the alternative actuator.

An alternative embodiment of a continuous height adjustable table is illustrated in FIG. 5 and generally designated 10'. Embodiment 10' differs from the embodiment 10 by substitution of an electrical screw jack actuator generally designated 190. Actuator 190 includes an extendable rod 192 received within a cylinder 194. A lead screw is rotated by an electric motor 196 to extend rod 192. In an existing embodiment, actuator 190 is obtained from Warner Electric Brake and Clutch, model ACB-10PB-12 and has an extension range of 12 inches.

Secured to the end of rod 192 is a suitable cross piece 198 to which are secured cables 200, 202. Cable 200 passes over a pulley 204 secured to an upper cross member of end panel assembly 18. The cable then passes downwardly through the leg structure as in the embodiment illustrated in FIGS. 2–4. Cable 202 passes over a direction changing pulley 206 into another pulley 208 secured to an upper cross member of end panel assembly 20. Cable 202 then passes downwardly through the telescoping leg structures 28 in the same manner as illustrated with cable 84 in FIG. 4. Actuator 190 including electric motor 196 is supported on cross pieces 210, 212 extending between side frame members 22, 24. A bracket 216 supports a lower limit switch 218. Another bracket 220 secured to side piece 24 supports an upper limit switch 222. Limit switches 218, 222 are positioned to be engaged by cross member 198 upon extension and retraction of rod 192 to thereby set the maximum upper and lower height adjustment limits of the table. Bracket 220 may be adjustably positioned to permit adjustment of the maximum height of the table.

Figure 6:
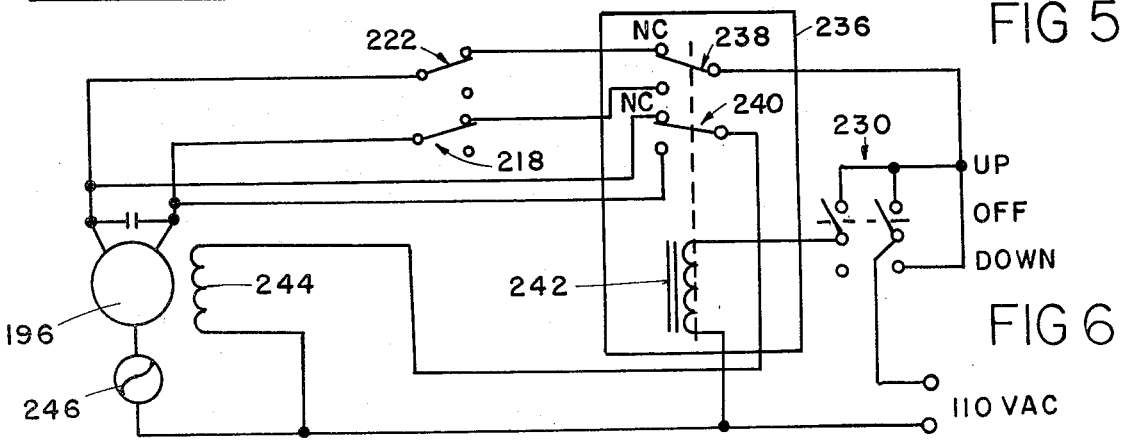
FIG. 6 is a schematic of an electrical control system for the alternative embodiment.

A control in the form of up-off-down switch 230 is mounted on side piece 24 and readily accessible and actuated with a straight line motion. A suitable control system for the electrical actuator 190 is schematically illustrated in FIG. 6. As shown therein, switch 230 actuates motor 196 in a forward and a reverse direction through an alternating current relay 236. Relay 236 includes switches 238, 240 actuated by a solenoid 242 in a conventional fashion. Motor 196 also includes an induction brake 244 and is protected by a thermal protector 246. As should be readily apparent, upon actuation of switch 230, motor 196 will be driven in a forward direction resulting in extension of rod 192. If switch 230 is switched to an up position, the motor 196 will continue to operate until cross piece 198 contacts the upper limit switch 222 opening the circuit and stopping the motor. Upon actuation of switch 230 to the down position, motor 196 is driven in a reverse direction until cross member 198 contacts lower limit switch 218 thereby opening the circuit and stopping the motor. The circuit illustrated in FIG. 6 is connected to a suitable source of electrical power, preferably 110 volt AC. When switch 230 is moved to the off position to select the desired table height, motor 196 is deactivated.

It will be readily apparent to those of ordinary skill in the art that the preferred and alternative embodiments of the continuously height adjustable table in accordance with the present invention permit a wheelchair occupant to easily adjust the positioning of the work surface to his or her particular needs. Very little effort is required to accomplish the height adjustment. The table is sturdy, reliable and easily manufactured.

In view of the foregoing description, those of ordinary skill in the art will undoubtedly envision various modifications to the present invention which would not depart from the inventive concepts disclosed herein. It is, therefore, expressly intended that the above description should be considered only as that of the preferred embodiments. The true spirit and scope of the present invention may be determined by reference to the appended claims.

The embodiments of the invention in which an exclusive property or privilege is claimed are defined as follows:

1. A continuous height adjustable wheelchair table, comprising:

a member defining a work surface;

a frame structure secured to an underside of said member;

a pair of leg structures, each positioned at an end of said member and said frame structure including means for telescopingly receiving said leg structures;

raising and lowering means positioned underneath said member and connected to said leg structures for continuously raising and lowering said member with respect to said leg structures, said raising and lowering means including:

an actuator having an extendible and retractable rod and means extending under and immediately adjacent the work surface to be accessible by hand operation, said actuator movable in a lineal path of travel for ease of operation by a handicapped operator for extending and retracting said rod;

control means for limiting the extension of said rod; and flexible motion transmitting means connected to said rod and said leg structures for raising and lowering said member as said rod extends and retracts.

2. A continuous height adjustable table as defined by claim 1 wherein said actuator comprises a hydraulic jack having a self-contained fluid reservoir, a lever operated pump to extend said rod and a bleed valve shiftable from a closed to an open position to permit retraction of said rod.

3. A continuous height adjustable wheelchair table, comprising:

a member defining a work surface;

a frame structure secured to an underside of said member;

a pair of leg structures, each positioned at an end of said member and said frame structure including means for telescopingly receiving said leg structures;

raising and lowering means positioned underneath said member and connected to said leg structures for continuously raising and lowering said member with respect to said leg structures, said raising and lowering means including;

an actuator having an extendible and retractable rod and means for extending and retracting said rod wherein said actuator comprises a hydraulic jack having a self-contained fluid reservoir, a lever operated pump to extend said rod, and a bleed valve shiftable from a closed to an open position to permit retraction of said rod;

control means for limiting the extension of said rod;

flexible motion transmitting means connected to said rod and said leg structures for raising and lowering said member as said rod extends and retracts;

a control handle;

means on said table for mounting said handle for reciprocating, straight line movement;

a spring having an end fixed with respect to said member and an end secured to said lever; and a cable extending from said control handle to said lever whereby straight line pulling movement of said handle shifts said lever against the bias of said spring and said rod extends from said hydraulic jack.

4. A continuous height adjustable table as defined by claim 2 wherein said actuator further includes:

an extension secured to said bleed valve, said extension being shiftable between a first position wherein said bleed valve is closed and a second position wherein said bleed valve is open, said control means shifting said extension to said second position to limit extension of said rod.

5. A continuous height adjustable wheel chair table, comprising:

a member defining a work surface;

a frame structure secured to an underside of said member;

a pair of leg structures, each positioned at an end of said member and said frame structure including means for telescopingly receiving said leg structures;

raising and lowering means positioned underneath said member and connected to said leg structures for continuously raising and lowering said member with respect to said leg structures, said raising and lowering means including:

an actuator having an extendible and retractable rod and means for extending and retracting said rod wherein said actuator comprises a hydraulic jack having a self-contained fluid reservoir, a lever operated pump to extend said rod, and a bleed valve shiftable from a closed to an open position to permit retraction of said rod, an extension secured to said bleed valve, said extension being shiftable between a first position wherein said bleed valve is closed and a second position wherein said bleed valve is open, said control means shifting said extension to said second position to limit extension of said rod;

control means for limiting the extension of said rod comprising a cam member adjustably carried by said flexible motion transmitting means; and a cam follower mounted on said extension and engaged by said cam member to shift said extension to said second position; and flexible motion transmitting means connected to said rod and said leg structures for raising and lowering said member as said rod extends and retracts.

6. A continuous height adjustable table as defined by claim 5 further including a control handle mounted for reciprocating, straight line movement and a cable secured at an end to said control handle and at another end to said extension so that reciprocation of said control handle shifts said extension between said first and second positions to permit lowering of said member by gravity.

7. A continuous height adjustable table as defined by claim 6 further including:

another control handle;

means on said table for mounting said another control handle for straight line, reciprocating movement;

a spring having an end fixed with respect to said member and an end secured to said lever; and a cable extending from said another control handle to said lever whereby reciprocation of said another control handle shifts said lever against the bias of said spring and said rod extends from said hydraulic jack.

8. A continuous height adjustable table as defined by claim 1 wherein said actuator comprises:

an electric motor;

a lead screw operatively connected to said electric motor for extending and retracting said rod; and push button switch means for selectively providing operating power to said motor.

9. A continuous height adjustable table as defined by claim 8 wherein said adjustable control means comprises:

a cross piece secured to said rod; and a pair of spaced limit switches electrically connected to said motor and positioned on said frame to be contacted by said cross piece, one of said switches being contacted to limit extension of said rod and the other of said switches being contacted to limit retraction of said rod.

10. A continuous height adjustable table as defined by claim 7 wherein said frame comprises:

vertically disposed channel members dimensioned to receive said leg structures, said leg structures each including a horizontal base member, a pair of vertical standards extending from said base member and an upper cross member extending between said vertical standards, said flexible motion transmitting means being connected to said upper cross member of each of said leg structures.

11. A height adjustable table adapted for wheelchair use, said table comprising:

a rectangular top member;

a pair of end panels depending from ends of said top member, each of said end panels defining a leg receiving channel;

a pair of legs telescopingly received within said end panels; and means for raising and lowering said top member and said end panels on said legs, said means including:

a pair of straight line control members mounted below said top member in a position readily accessible to a wheelchair occupant, one of said control members being operable to raise said top member and the other of said control members being operable to lower said top member;

an actuator having an extendable, and retractable rod and drive means for extending and retracting said rod;

control connecting means for connecting said control members to said actuator;

flexible connecting means extending from said rod to said legs over a plurality of pulleys, said pulleys positioned with respect to said end panels and said legs so that extension and retraction of said rod raises and lowers said top member; and height limiting means mounted beneath said top member for automatically limiting the maximum height of said top member with respect to said legs.

12. A height adjustable table as defined by claim 11 wherein said actuator comprises a standard hydraulic jack of the type having a cylinder, a piston secured to said rod, a reservoir, a lever actuated pump and a bleed valve, said actuator further including means secured to said bleed valve for biasing said bleed valve to a closed position, said top member lowering under gravity when said bleed valve is moved to an open position.

13. A height adjustable table as defined by claim 12 wherein said other of said control members is connected to said means for biasing said bleed valve and said one of said control members is connected to said lever.

14. A height adjustable table as defined by claim 13 wherein said height limiting means comprises a cam adjustably positioned on said flexible connecting means and said means for biasing includes a cam follower engaged by said cam and moving said bleed valve to its open position when the desired maximum height of said top member is reached.

15. A height adjustable table as defined by claim 14 further including:

a spring fixed at an end beneath the top member and secured at another end to said lever, said control connecting means including a cable connected at one end to said one control member and at another end to said lever.

16. A height adjustable table as defined by claim 15 wherein said means for biasing further includes:

a socket;

an extension rotatably disposed within said socket and secured to said bleed valve; and a spring having an end fixed to said socket and an end fixed to said extension.

17. A height adjustable table as defined by claim 11 wherein said actuator comprises:

an electric motor; and drive means operatively engaged by said motor for extending and retracting said rod, said control members comprising an up switch and a down switch electrically connected to said motor and said height limiting means comprising a cross piece fixed to said rod and a limit switch engaged by said cross piece when the maximum height of said top member is reached.

* * * * *

UNITED STATES PATENT AND TRADEMARK OFFICE

CERTIFICATE OF CORRECTION

PATENT NO. : 4,315,466

DATED : February 16, 1982

INVENTOR(S) : Milton E. Boerigter

It is certified that error appears in the above—identified patent and that said Letters Patent is hereby corrected as shown below:

Column 6, Claim 1, line 47
"extendible" should be --extendable--

Column 7, Claim 3, line 10
"extendible" should be --extendable--

Column 7, Claim 5, line 53
"extendible" should be --extendable--

Signed and Sealed this

*Sixth* Day of *July 1982*

[SEAL]

*Attest:*

GERALD J. MOSSINGHOFF

*Attesting Officer*

*Commissioner of Patents and Trademarks*